US009705290B2

(12) United States Patent
Linton

(10) Patent No.: US 9,705,290 B2
(45) Date of Patent: Jul. 11, 2017

(54) SPARK PLUG BOOT COVER ASSEMBLY

(71) Applicant: WALBRO LLC, Tucson, AZ (US)

(72) Inventor: Robby L. Linton, Saginaw, MI (US)

(73) Assignee: Walbro LLC, Tucson, AZ (US)

( * ) Notice: Subject to any disclaimer, the term of this patent is extended or adjusted under 35 U.S.C. 154(b) by 12 days.

(21) Appl. No.: 14/963,376

(22) Filed: Dec. 9, 2015

(65) Prior Publication Data

US 2016/0211653 A1 Jul. 21, 2016

Related U.S. Application Data

(60) Provisional application No. 62/104,403, filed on Jan. 16, 2015.

(51) Int. Cl.

| | |
|---|---|
| ***H01R 13/44*** | (2006.01) |
| ***H01T 13/06*** | (2006.01) |
| ***H01T 13/04*** | (2006.01) |
| ***H01T 13/05*** | (2006.01) |

(52) U.S. Cl.

CPC ..... *H01T 13/06* (2013.01); *H01T 13/04* (2013.01); *H01T 13/05* (2013.01)

(58) Field of Classification Search

CPC .... H01R 101/00; H01R 4/4818; H01R 31/02; H01R 25/003

USPC ..... 439/125, 440, 787, 654

See application file for complete search history.

(56) References Cited

U.S. PATENT DOCUMENTS

| | | | | |
|---|---|---|---|---|
| 1,967,480 | A * | 7/1934 | Ruther | H01T 13/04 123/169 PH |
| 9,385,516 | B2 * | 7/2016 | Tanaka | H02G 3/22 |
| 2013/0333944 | A1 * | 12/2013 | Sakakura | H01R 13/5804 174/74 R |

* cited by examiner

*Primary Examiner* — Phuongchi T Nguyen

(74) *Attorney, Agent, or Firm* — Reising Ethington P.C.

(57) ABSTRACT

An electrically conductive cover which in assembly is received over at least part of a spark plug boot and at least part of a nut portion of a metal body of a spark plug received in the boot. The cover may have an opening through which an arm portion of the boot extends which arm portion receives an electric wire for supplying a current at a high potential voltage to the spark plug.

20 Claims, 2 Drawing Sheets

SPARK PLUG BOOT COVER ASSEMBLY

REFERENCE TO RELATED APPLICATION

This patent application claims the benefit under 35 U.S.C. §119(e) of the earlier filed provisional patent application, Ser. No. 62/104,403, filed under 35 U.S.C. §111(b) on Jan. 16, 2015, which is incorporated herein in its entirety by reference.

TECHNICAL FIELD

The present disclosure relates generally to spark plug boot covers. More particularly, the disclosure relates to covers for spark plug boots that inhibit the propagation of electromagnetic interference.

BACKGROUND

Gasoline powered spark ignition internal combustion engines and particularly light duty and small engines are used on a large variety of products including handheld, lawn and garden, marine, snowmobile and other home and commercial products. These engines are typically two-cycle or four-cycle engines with one or more cylinders and have a spark plug for each cylinder which in use initiates combustion of a fuel-and-air mixture in the cylinder. The spark plug is typically threaded or otherwise secured in a bore in a metal cylinder head or cylinder of the engine which provides a ground for a metal shell or body of the spark plug which has an electrical ground electrode adjacent one end and for installing or removing the spark plug a non-circular and typically hexagonal nut portion adjacent its other end. An electrically conductive center electrode typically with a copper core extends through the metal body with one end spaced by a gap from the ground electrode and is received in a typically ceramic insulator which projects from the other end of the body and carries an electrically conductive terminal connected to the center electrode.

In use, though an insulated wire with an end clip removably connected to the terminal, a high potential voltage current is supplied to the center electrode to produce an arc or spark in the gap. Typically, an electrically insulating boot is generally coaxially received over the terminal and an exposed portion of the insulator of the spark plug and terminates short of or adjacent the upper end of the spark plug shell or body. Typically, the boot has an integral arm portion through which the insulated electric wire extends and this arm portion typically is inclined at an acute included angle usually of about 90° or 45° to the longitudinal axis of the main body of the boot and the spark plug. In many small engine applications, in use the high potential voltage is supplied to this wire by a so-called switch or module controlling the ignition timing which is typically part of an electromagneto capacitive discharge ignition system.

When in use in an operating engine, the arcing or spark produced by the spark plug creates electromagnetic interference (EMI) which may adversely affect the circuitry of the module controlling ignition timing and/or other engine operations which adversely affects engine performance or it may adversely affect other electronic circuitry of the product on which the engine is used or in some instances other devices or products in the vicinity in which the engine is operating.

SUMMARY

In at least some implementations, an electrically conductive cover is configured to be received over at least a significant portion of the main body of a spark plug boot and to extend over at least part of the nut portion of the metal body of the spark plug. The cover may have a firm friction fit such as an interference fit with the nut portion of the spark plug body. The cover may have a closed end and/or an opening thorough which an arm of the boot extends for receiving a portion of an electric wire for supplying power to a spark plug. The cover may be made of an electrically conductive synthetic rubber material with a surface resistance of less than 8,000 ohms per square and/or a volume resistance of less than 85,000 ohms-centimeter.

BRIEF DESCRIPTION OF THE DRAWINGS

The following detailed description of certain embodiments and best mode will be set forth with reference to the accompanying drawings, in which.

DETAILED DESCRIPTION

Figure 1:
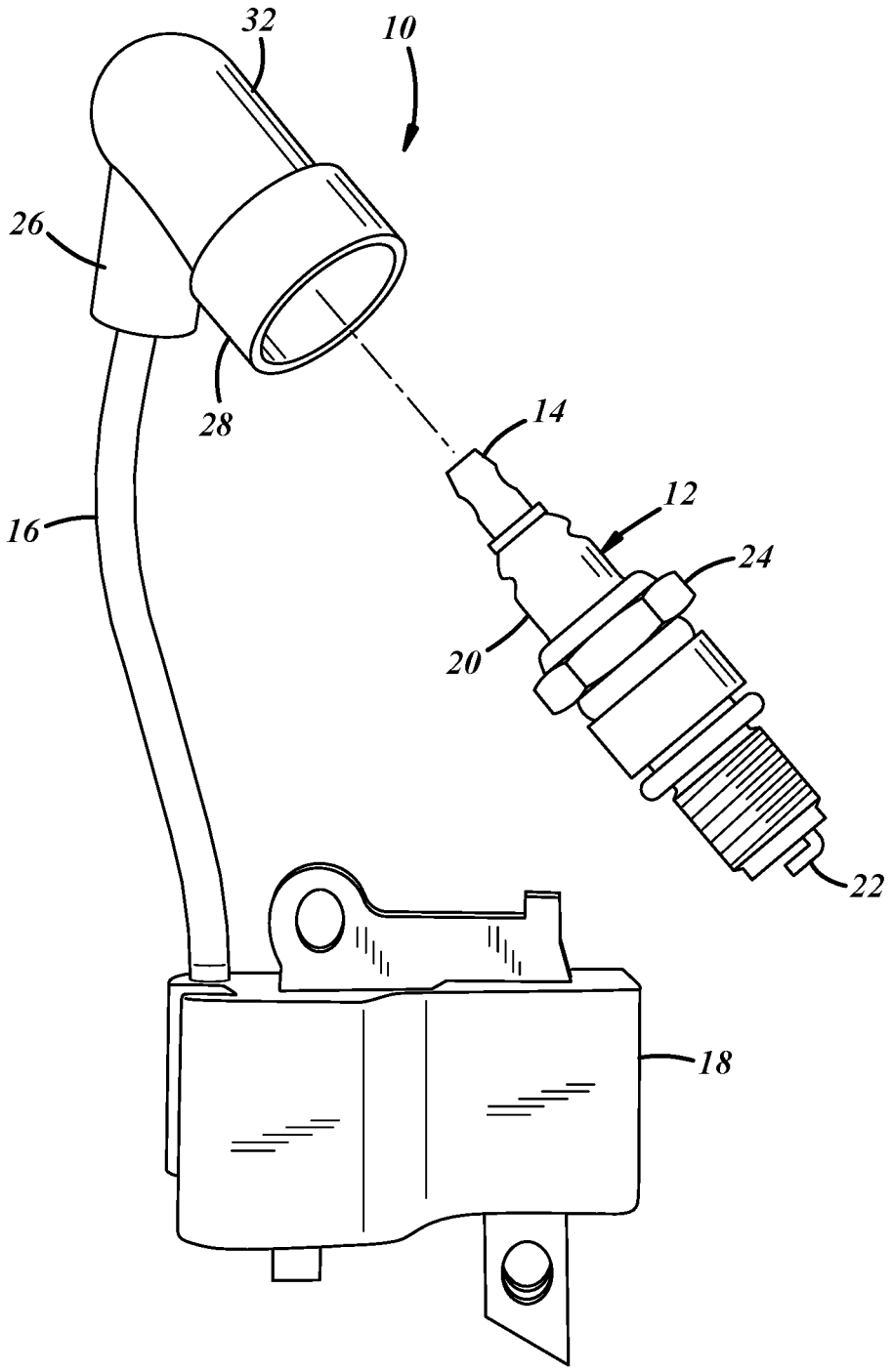
FIG. 1 is a an exploded perspective view of one embodiment of the invention with a portion of an electric circuit inserted therein and a spark plug.

Referring to FIG. 1, one embodiment of the invention is generally indicated at 10. The invention 10 includes a conductive cover assembly 10 for a spark plug, generally shown at 12. The spark plug 12 includes a terminal 14 that is electrically connected to an electrical circuit, represented by wire 16 and switch 18. The spark plug 12 includes a ceramic body 20, a ground electrode 22 and a nut surface 24. The nut surface 24 is disposed between the ceramic body 20 and the ground electrode 22 and is the surface about which a manual tool is used to tighten the spark plug 12 onto an internal combustion engine (not shown).

The electrical circuit 16 also includes a connector (not shown), which is a spring electrode that is forced over the terminal 14 to complete the electrical connection between the switch 18 and the spark plug 12. This spring electrode is covered by a spark plug boot 26 (only partially shown in FIG. 1).

Figure 3:
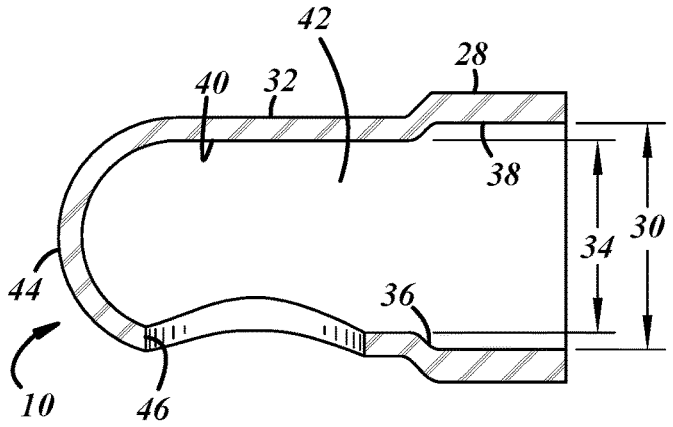
FIG. 3 is a cross-sectional view taken along lines A-A of FIG. 2.
Figure 2:
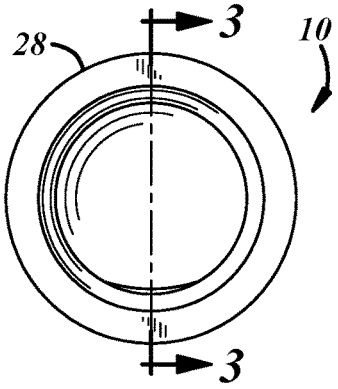
FIG. 2 is an end view of one embodiment of the invention.
Figure 4:
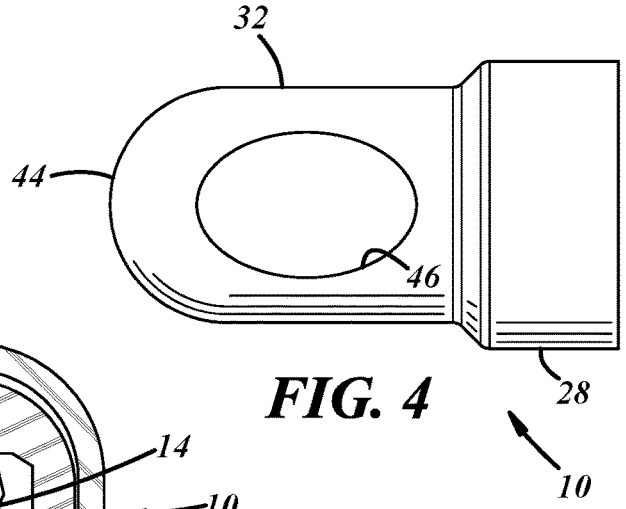
FIG. 4 is a side view of one embodiment of the invention.

Referring now to all of the Figures, the conductive cover assembly 10 includes a base 28. The base 28 defines an inner base diameter 30 (identified in FIG. 3). The inner base diameter 30 complements the nut surface 24 of the spark plug 12. More specifically, the inner base diameter 30 is of a dimension that allows it to be forced over the nut surface 24 of the spark plug 12 in a manner in which the conductive cover assembly 10 is friction fit to the nut surface 24 with enough force to keep the conductive cover assembly 10 in place.

The conductive cover assembly 10 includes an conducting cover 32 that extends up from the base 28. The conducting cover 32 covers the spark plug 12 and the spark plug boot 26. More specifically, the conducting cover 32 covers the portion of the spark plug 12 that is exposed outside the internal combustion engine and the portion of the spark plug boot 26 that is coaxial with the spark plug 12. As is shown in FIG. 1, a portion of the spark plug boot 26 extends out from the conducting cover 32 (discussed in greater detail subsequently).

The conductive cover assembly 10 is fabricated from ethylene propylene diene monomer (EPDM) rubber. The EPDM rubber is infused with graphite such that the EPDM rubber is conductive. The EPDM rubber infused with graphite within the conductive cover assembly 10 creates a grounding shield to protect the area disposed immediately adjacent the spark plug electrode 14 from electromagnetic interference (EMI). In an alternative embodiment, the EPDM rubber may be infused with carbon black instead of graphite. In a preferred embodiment, the conductive cover assembly 10 has a surface resistivity less than or equal to 108 Ωcm and a volume resistivity of less than or equal to 109 Ωcm.

The EPDM rubber has been tested to have a hardness of 55 Shore A at a temperature of 350° Fahrenheit after ten minutes of heating. The tensile strength of the EPDM rubber is 1,819 psi at the same temperature for the same time.

The conducting cover 32 defines a cover inner diameter 34 (FIG. 3) that is less than the inner base diameter 30. A relief surface 36 extends between an inner base surface 38 and an inner cover surface 40. The cover inner diameter 34 may be large enough to create an air gap 42 between the inner cover surface 40 on the one hand and spark plug 12 and the spark plug boot 26 on the other hand. The air gap 42 provides a level of insulation, which adds to the insulation provided by the spark plug boot 26. Any EMI that passes through these layers is dissipated by the conductive properties of the EPDM rubber and the conductive cover assembly 10, which act as a grounded material.

The conducting cover 32 includes a closed distal end 44 and a circuit opening 46. The circuit opening 46 is disposed between the closed distal end 44 and the base 28 of the conductive cover assembly 10. The circuit opening 46 provides access allowing a portion of the spark plug boot 26 shown in FIG. 1 to extend out from the conductive cover assembly 10 and allow the electrical circuit 16 to extend into the conductive cover assembly 10.

Figure 5:
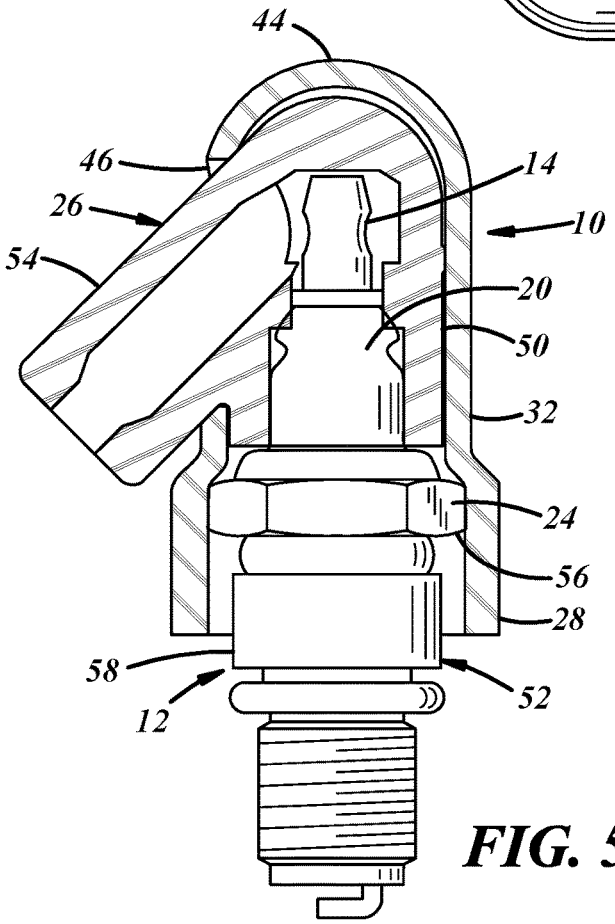
FIG. 5 is an enlarged sectional view of one embodiment of the invention received over a spark plug boot assembled on a spark plug.

As shown in FIG. 5, in assembly and in use, the separate cover assembly 10 is received over the main body 50 of the boot 26 which is disposed on the spark plug 12. The main body 50 of the boot terminates short of or bears on the upper end of the spark plug metal shell or body 52, and an arm 54 of the boot projects outwardly through the opening 46 in the cover assembly. The lower base portion 28 desirably, but not necessarily, extends over the entire axial extent of the nut portion 56 of the spark plug 12 preferably with a slight interference fit and preferably is slightly stretched within its elastic limit to provide a firm interference fit with the nut portion 56 over substantially the entire axial and circumferential extent of the peripheral nut surface 24 to thereby provide a good electrical connection or grounding between the cover assembly 10 and the spark plug shell 52. This frictional engagement with the shell may releasably retain the cover on the boot and the spark plug. Desirably, there may also be a slight interference fit between at least a portion of the cover sidewall inner surface 40 and the main body portion 50 of the boot 26 to releasably retain the cover assembly 10 on the boot 26.

Preferably, the base portion 28 of the cover assembly 10 carries axially downwardly beyond the nut portion 56 and over at least as much of the cylindrical portion 58 of the shell 52 of the spark plug and terminates closely adjacent to the cylinder head or cylinder body on which the spark plug is assembled when in use.

Desirably, the cover assembly 10 is made of an at least somewhat resilient and flexible synthetic rubber which has been doped or infused with graphite, carbon black, or other conductive material so that the cover assembly is conductive and preferably has a surface resistance of less than 8,000 ohms per square and a volume resistance of less than 85,000 ohms-cm as measured and determined in accordance with ASTM Standard D257. Suitable synthetic rubber materials include EPDM, silicone, thermoplastic elastomers (TPE), and the like. Desirably, the synthetic rubber has good heat, ozone and weather resistance. Preferably, the synthetic rubber has a relatively high temperature resistance of at least about 250° F. and preferably 350° F. Preferably, the synthetic rubber has a durometer on the Shore A scale in the range of about 50 to 60 at a temperature of 350° F.

For ease of assembly, preferably the cover 10 is assembled over the boot 26 before the boot and cover are assembled over the spark plug 12. Even if the high tension insulated wire 16 is assembled in the boot 26 before the cover 10, the cover may be readily assembled over the boot by inserting the body portion 50 of the boot through the opening 46 in the resilient cover assembly 10 and into the interior of the cover. This installation of the separate cover assembly 10 is advantageous both when the cover is assembled during original equipment manufacture (OEM) of the spark plug boot 26, before or after insertion of the high tension wire 16 into the boot 26, before or after the high tension wire 16 is attached to an ignition module 18, before or after manufacture of the spark ignition engine, after the engine has been assembled into the product it powers, and even in the aftermarket after the engine or the end or product it powers has been distributed or sold. The manufacture or use of a separate cover is also less expensive than overmolding the conductive cover on an electrically insulative boot during manufacture of the boot.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A conducting cover and boot assembly for a spark plug having an electrode terminal and a conducting metal shell with a nut portion, the conducting cover assembly comprising:

a flexible cover formed from an electrically conductive material, wherein the material includes at least one of EPDM, rubber, silicone rubber, or TPE and the material is infused with at least one of graphite or carbon black, and the cover has an integral annular base that, in assembly on a spark plug, engages a surface of the nut portion of the metal shell of the spark plug to provide an electrically conductive connection between the cover and the metal shell, and a boot that surrounds the terminal when installed on the spark plug, the boot is received at least partially within the cover so that the boot is arranged between the terminal and the flexible cover, and the boot is formed from an electrically insulative material.

2. The conducting cover and boot assembly of claim 1 wherein the material of the cover has a surface resistance of less than 8,000 ohms per square.

3. The conducting cover and boot assembly of claim 1 wherein the material of the cover has a surface resistance of less than 8,000 ohms per square and a volume resistance of less than 85,000 ohms-cm.

4. The conducting cover and boot assembly of claim 1 wherein the base has an inside diameter less than an outside diameter of the nut portion of the metal shell of the spark plug when the cover is an unstretched state and the cover is at least somewhat flexible and resilient so that the cover is received over the nut with an interference fit.

5. The conducting cover and boot assembly of claim 1 wherein at least a part of the cover has an inside diameter larger than a complimentary portion of the boot to create an air gap between them when in assembly.

6. The conducting cover and boot assembly of claim 1 wherein the cover includes a closed end distal from the base.

7. The conducting cover and boot assembly of claim 1 wherein the cover includes an opening disposed between the closed distal end and the base and wherein the boot has an arm portion configured to extend through the opening in the cover when the boot is received within the cover and the arm of the boot is configured to receive a high potential voltage wire for connection to the terminal of the spark plug.

8. The conducting cover and boot assembly of claim 7 wherein the material of the cover has a surface electrical resistance of less than 8,000 ohms per square.

9. The conducting cover and boot assembly of claim 7 wherein the material of the cover is an at least somewhat resilient and flexible synthetic rubber having a surface resistance of less than 8,000 ohms per square.

10. The conducting cover and boot assembly of claim 9 wherein the synthetic rubber material has a volume resistance of less than 85,000 ohms-cm.

11. A conducting cover and boot assembly for a spark plug having a metal nut surface and a terminal for electrical connection to an electrical circuit, said assembly comprising:

a flexible cover formed from ethylene propylene diene monomer rubber infused with graphite, and the cover has a base that, in assembly on a spark plug, engages the metal nut surface of the spark plug to provide an electrically conductive connection between the cover and the metal nut surface; and a boot that surrounds the terminal when installed on the spark plug, the boot is received at least partially within the cover so that the boot is arranged between the terminal and the flexible cover, and the boot is formed from an electrically insulative material.

12. The conducting cover and boot assembly as set forth in claim 11 wherein the cover has a surface resistivity less than or equal to 108 Ωcm.

13. The conducting cover and boot assembly as set forth in claim 11 wherein said cover has a portion with an inner diameter that is large enough to create an air gap between at least a portion of said cover and the boot.

14. The conducting cover and boot assembly as set forth in claim 11 wherein the cover has a volume resistivity less than or equal to 109 Ω-cm.

15. The conducting cover and boot assembly set forth in claim 11 wherein the cover has a surface resistivity less than or equal to 8,000 ohms per square.

16. The conducting cover and boot assembly set forth in claim 11 wherein the cover has a volume resistivity less than or equal to 85,000 ohms-cm.

17. The conducting cover and boot assembly as set for in claim 11 wherein said cover includes a closed distal end.

18. The conducting cover and boot assembly as set forth in claim 17 wherein said cover includes an opening disposed between said base and said closed distal end to receive a portion of an electrical circuit therethrough.

19. An assembly for a spark plug, the spark plug having a terminal, a conducting metal shell with a nut portion and a boot surrounding the terminal, the assembly comprising:

a cover formed from a synthetic rubber material wherein the material includes at least one of EPDM, rubber, silicone rubber, or TPE and the material also includes electrically conductive elements so that the cover is electrically conductive and flexible, the cover being sized for receipt over at least a portion of the boot and the cover having an integral base with an inner diameter of a size to engage a surface of the nut portion of the metal shell of the spark plug to provide an electrically conductive connection between the cover and the metal shell.

20. The assembly of claim 19 wherein the conductive elements include at least one of graphite or carbon black.

* * * * *